US011122924B2

(12) United States Patent
Williams, Jr.

(10) Patent No.: US 11,122,924 B2
(45) Date of Patent: Sep. 21, 2021

(54) BRACKET SYSTEM FOR HATS

(71) Applicant: Staybill, LLC, Tempe, AZ (US)

(72) Inventor: Carl Edward Williams, Jr., Tempe, AZ (US)

(73) Assignee: Staybill, LLC, Scottsdale, AZ (US)

( * ) Notice: Subject to any disclaimer, the term of this patent is extended or adjusted under 35 U.S.C. 154(b) by 0 days.

(21) Appl. No.: 17/001,871

(22) Filed: Aug. 25, 2020

(65) Prior Publication Data

US 2021/0059451 A1 Mar. 4, 2021

Related U.S. Application Data

(60) Provisional application No. 62/892,191, filed on Aug. 27, 2019.

(51) Int. Cl.

| | |
|---|---|
| ***A47G 25/10*** | (2006.01) |
| ***A47F 5/08*** | (2006.01) |
| ***A47F 7/06*** | (2006.01) |
| ***A47B 61/04*** | (2006.01) |

(52) U.S. Cl.

CPC ..... *A47G 25/10* (2013.01); *A47B 61/04* (2013.01); *A47F 5/0876* (2013.01); *A47F 7/06* (2013.01)

(58) Field of Classification Search

CPC ..... A47G 25/10; A47F 5/0876; A47F 7/06; A47B 61/04

See application file for complete search history.

(56) References Cited

U.S. PATENT DOCUMENTS 224,003 A * 2/1880 Drew ..... A47G 25/0607 248/304
273,698 A * 3/1883 Alcott ..... A47G 25/10 248/304
370,959 A * 10/1887 Lotz ..... A47G 25/10 211/32
424,239 A * 3/1890 Williams et al. ..... A47G 25/10 248/304
451,568 A * 5/1891 Murrin ..... A47G 25/10 248/304
532,109 A * 1/1895 Stinchcomb et al. ..... A47G 25/0607 248/303
539,194 A * 5/1895 Savoie ..... A47G 25/10 211/32
547,856 A * 10/1895 Matthies ..... A47G 25/10 211/32
601,502 A * 3/1898 Cummings et al. ... A47G 25/10 211/32

(Continued)

FOREIGN PATENT DOCUMENTS

FR 2932664 A1 * 12/2009 ..... A47G 25/32
GB 190909449 A * 7/1909 ..... A47G 25/10

*Primary Examiner* — Stanton L Krycinski
(74) *Attorney, Agent, or Firm* — Miller & Martin PLLC; Stephen J. Stark

(57) ABSTRACT

A hat bracket supports hats having a bill extending from a crown. The bracket has a back plate which may have bores therethrough. The back plate connects at an upper portion to a top arm which extends forwardly and downwardly relative to the back plate. A bottom arm extends forwardly and upwardly relative to the back plate and provides a hat support, such as a whale tail, onto which a rear of the crown is supported with the bill extending upwardly and prevented from outward rotation by the top arm. Multiple brackets may be connected together.

15 Claims, 11 Drawing Sheets

(56) References Cited

U.S. PATENT DOCUMENTS 815,893 A * 3/1906 Adams et al. ..... A47G 25/10 211/32
846,956 A * 3/1907 Shaw ..... A47G 25/10 211/32
906,537 A * 12/1908 Lawson ..... A47G 25/10 248/304
908,320 A * 12/1908 Page ..... A47G 25/10 248/304
973,173 A * 10/1910 Comeau et al. ..... A47G 25/10 211/30
1,049,971 A * 1/1913 Appleby ..... A47G 25/10 248/303
1,162,375 A * 11/1915 Legros ..... A47G 25/10 248/218.1
1,294,916 A * 2/1919 Knight ..... A47H 7/02 211/103
1,305,560 A * 6/1919 Okamoto ..... A47G 25/10 248/304
1,572,973 A * 2/1926 Tait ..... A47G 25/10 211/32
1,837,692 A * 12/1931 Thomas ..... A47G 25/10 211/32
D93,637 S * 10/1934 Schirrmacher ..... D6/323
RE20,448 E * 7/1937 Van Aken ..... A47G 25/10 211/32
2,191,934 A * 2/1940 Epstein ..... A47G 25/10 211/32
2,590,401 A * 3/1952 Gordon ..... A47G 25/10 211/32
2,630,921 A * 3/1953 Stephenson ..... A47G 25/10 211/32
2,633,246 A * 3/1953 Guthrle ..... A47G 25/10 211/32
2,670,084 A * 2/1954 Evans ..... A47G 25/10 211/32
2,707,564 A * 5/1955 Smith ..... A47G 25/10 211/32
2,720,984 A * 10/1955 Gotowka ..... A47G 25/10 211/30
2,761,644 A * 9/1956 Bruno ..... A47G 25/10 248/303
2,842,329 A * 7/1958 Friedman ..... A47G 25/10 248/308
3,108,723 A * 10/1963 Hickey ..... A47G 25/10 223/66
3,208,597 A * 9/1965 Hansen ..... A47G 25/10 211/32
5,169,007 A * 12/1992 McHendry ..... A47F 7/06 211/119
5,188,325 A * 2/1993 Hilty ..... A47F 7/06 211/30
5,246,195 A * 9/1993 Huff ..... A47J 47/16 248/309.1
5,538,144 A * 7/1996 Reed ..... A47F 7/06 211/32
D401,840 S * 12/1998 Goodman ..... D8/367
5,921,403 A * 7/1999 Coffaro ..... A47F 7/06 211/30
D473,453 S * 4/2003 Goodman ..... D8/367
D506,076 S * 6/2005 Weisgerber ..... D6/317
7,168,577 B1 * 1/2007 Moseley ..... A47F 7/06 211/32
D540,659 S * 4/2007 Schmidt ..... D8/367
D564,243 S * 3/2008 Zhang ..... D6/323
D625,583 S * 10/2010 Benson ..... D8/367
7,900,883 B2 * 3/2011 Portz ..... A47G 25/0607 248/215
D644,502 S * 9/2011 Portz ..... D8/372
D742,729 S * 11/2015 Morrison ..... D8/373
10,117,535 B2 * 11/2018 Wood ..... A47F 7/065
2005/0109906 A1 * 5/2005 Arauzo Garcia .... A47G 25/746 248/309.4
2008/0111041 A1 * 5/2008 Drew ..... A47G 25/10 248/303
2018/0142833 A1 * 5/2018 Sasson ..... F16M 13/022
2019/0298092 A1 * 10/2019 Arrants ..... A42B 3/06

* cited by examiner

BRACKET SYSTEM FOR HATS

CLAIM OF PRIORITY

This application claims the benefit of U.S. Provisional Patent Application No. 62/892,191 filed Aug. 27, 2019, which is incorporated herein by reference in its entirety.

FIELD OF THE INVENTION

This invention pertains to bracket(s) for holding and/or displaying hat and ball caps and more specifically, the invention pertains to storage, organization and/or protection of hats and ball caps, so when utilized, the invention may provide protection of the integrity of a hat shape as originally manufactured, provide variety of configurations for organization of more than one hat or ball cap and/or allow for infinite connection of multiple devices to benefit a user.

BACKGROUND OF THE INVENTION

Hat hangers are well known. Typically, hangers are utilized to organize groups of hats as a space saving measure. Most hat hangars engage the hat by the bill, bead or back of the hat. Generally, there are individual hanging posts that accommodate garments as well as hats, a single device with multiple mounting points that can be strapped or hung to doors and walls. Either configuration or most other available hat hanging devices do not take into consideration the strongest point on a hat and engage that point when hanging or storing. As a result, the original configuration of the hat is altered over time and loses its shape and integrity as the bill, bead or back are stressed.

Current devices typically allow for hats to be hung on a single post or mount, side by side. Single posts or mounts provide no options for hanging multiple hats. Single posts are often mounted on doors and walls. Other devices in the marketplace provide options for a defined number of hats to be mounted on one device but are limited to the number of contact points pre-determined by the manufacturer. Improvements would be helpful over the prior art.

SUMMARY OF THE INVENTION

It is an object of the present invention to provide an improved bracket for at least some embodiment for organizing and preserving hats or caps (such as baseball caps). Many embodiments of the present invention are designed to overcome these realities and/or limitations created by currently available devices. The present invention may engage the hat or ball cap on the front back of the bill where the crown meets the bill. The natural balance point of the hat may be in this position, so stress to the bill, bead and/or back of the hat may be eliminated. The width of the contact point, "Whale tail", is designed to distribute focus along the back of the bill and/or to provide additional strength and balance to potentially protect the integrity of the hat.

The device may be designed to accommodate a single hat or ball cap, a single hat or ball cap collapsed back under, 3 hats collapsed and/or folded under per each device or level and/or stacked hats at each level. The device is designed to connect from the top and bottom with a unique trapezoid sliding and locking design allowing for an infinite number of connections and hats or ball caps to be mounted.

The device may be designed such that while one unit is attached to a flat surface, additional device units can be attached without the need to remove the "anchored" device unit already mounted.

The device may be attached to any flat surface via permanent and temporary means. The device may be attached back to back, top and bottom screw holes are provided to ensure maximum strength and versatility.

BRIEF DESCRIPTION OF THE DRAWINGS

These and other features, aspects and advantages of the present invention will become better understood with reference to the following descriptions and accompanying drawings where:

FIG. 2;

DETAILED DESCRIPTION OF THE INVENTION

Figure 1:
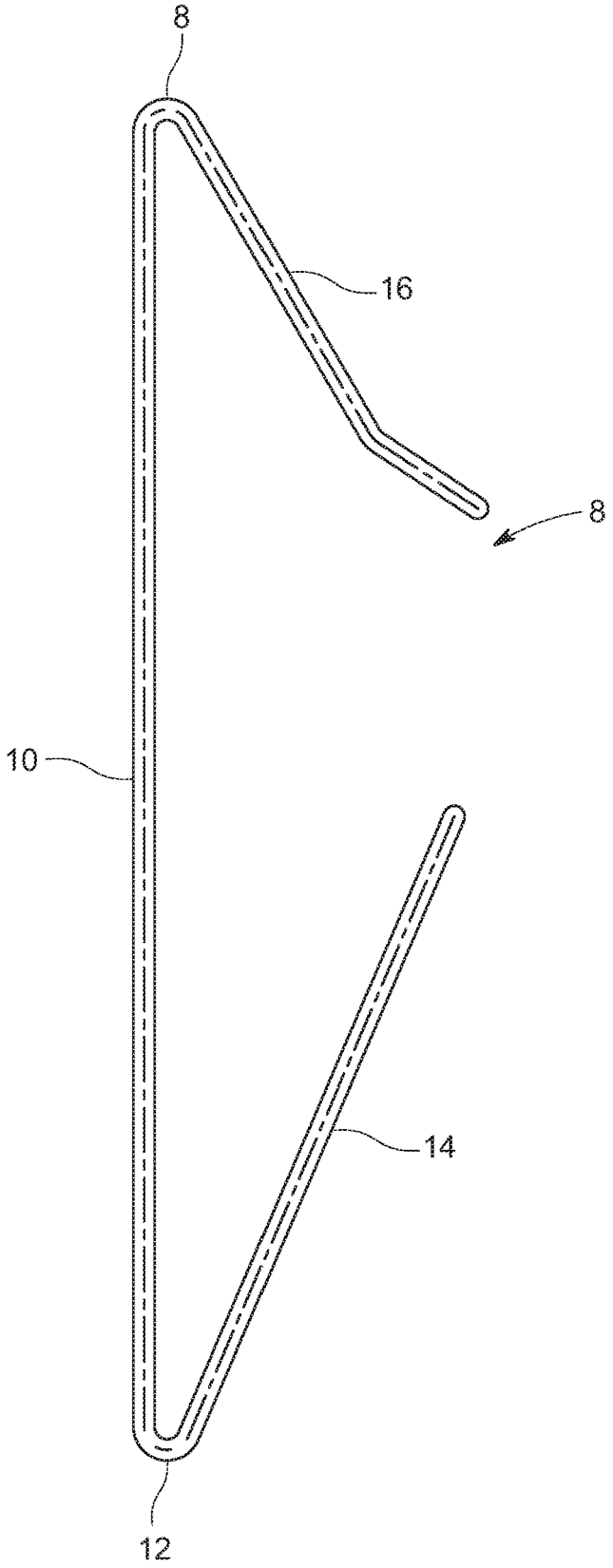
FIG. 1 is a side schematic view of a preferred embodiment of a hat bracket of the present invention.

FIG. 1 shows a schematic representation of a side view of the present preferred embodiment of the present invention of a bracket 8 having a back plate 10 connected at a bottom portion 12 of the back plate 10 to a bottom arm 14 which upwardly extends relative to the bottom 12 of the back plate 10 to support a hat thereon. Additionally, a top arm 16 connects to an upper portion 18 of the back plate 10 and then downwardly extends therefrom to keep the bill of a hat from pulling off the bracket 8.

Figure 2:
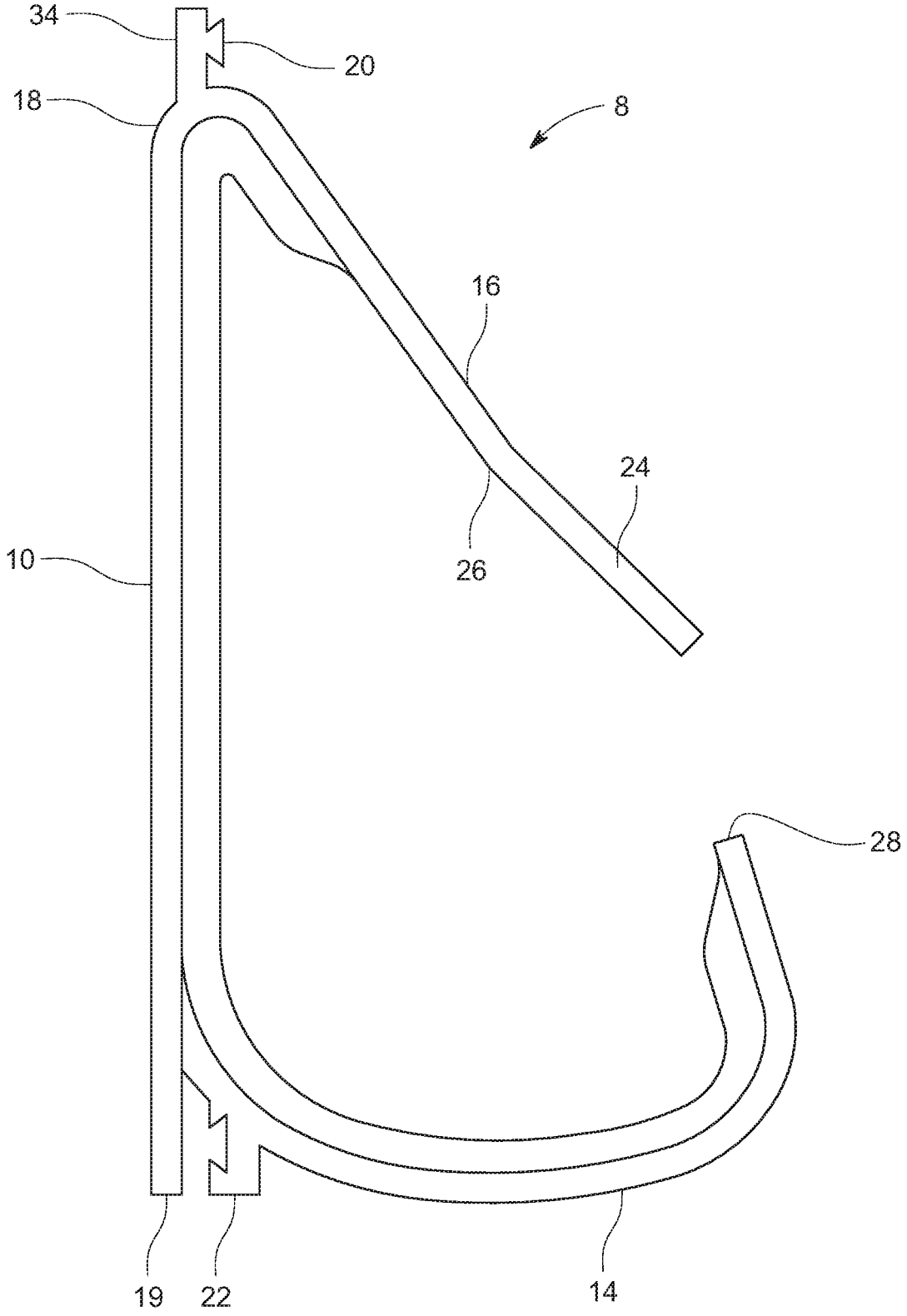
FIG. 2 is a side plan view of a preferred embodiment of the design.

FIG. 2 shows a more detailed version of the bracket 8. A first connector 20 such as a male connector and/or trapezoidal slide lock is shown at the upper portion 18 even extending above the upper portion 18 of the back plate 10 and is connectable to a second connector 22 such as a female connector trapezoidal slide lock at a lower portion 19 of back plate 10 so as to be able to connect multiple brackets 8 to one another in vertical relationship.

The top arm 16 may have a medallion 15 angularly connected to upper portion 18 such as a marketing medallion 24 connected at an angle 26 for at least some embodiments.

Figure 3:
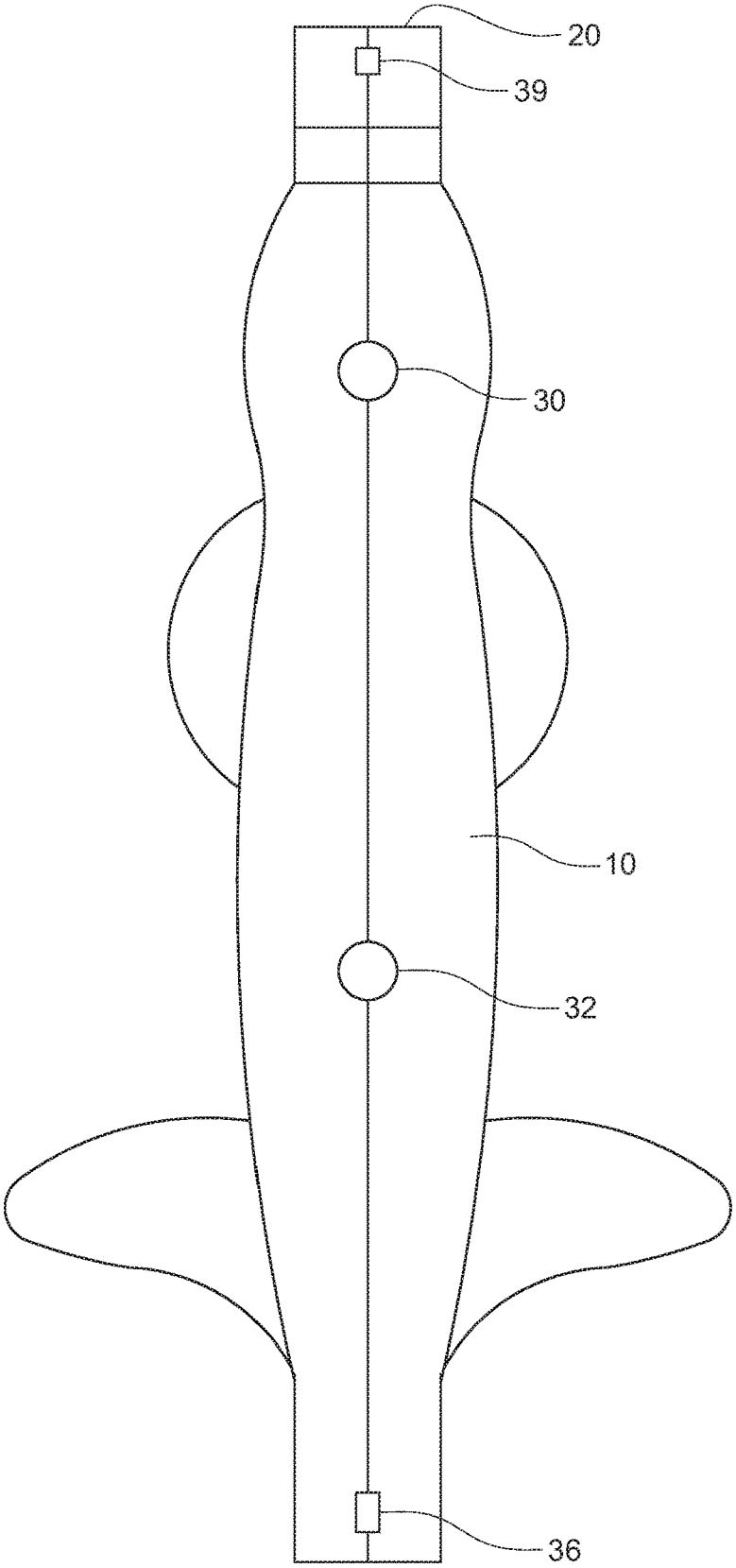
FIG. 3 is a back plan view of the embodiment of FIG. 2.

The bottom arm 14 may include a whale tail 28 which extends upwardly relative to the back plate 10. Other embodiments may have other constructions. The rear of the back plate 10 is illustrated in FIG. 3 having a first bore 30 and a second bore 32 which may receive screws or other connector so as to connect a back plate 10 to a vertical surface such as a wall, door or other appropriate structure. Additionally, the first connector 20 may have a nipple 34 which may be received in a recess 36 of second connector 22 (or visa versa) for connecting multiple brackets in a vertical arrangement one another with first connector 20 being received within second connector 22 if so constructed. Other embodiments may have different connectors 22,24 at the top and bottom portions such as upper and lower portions 18,20,22 of back plate 10 or otherwise.

Figure 4:
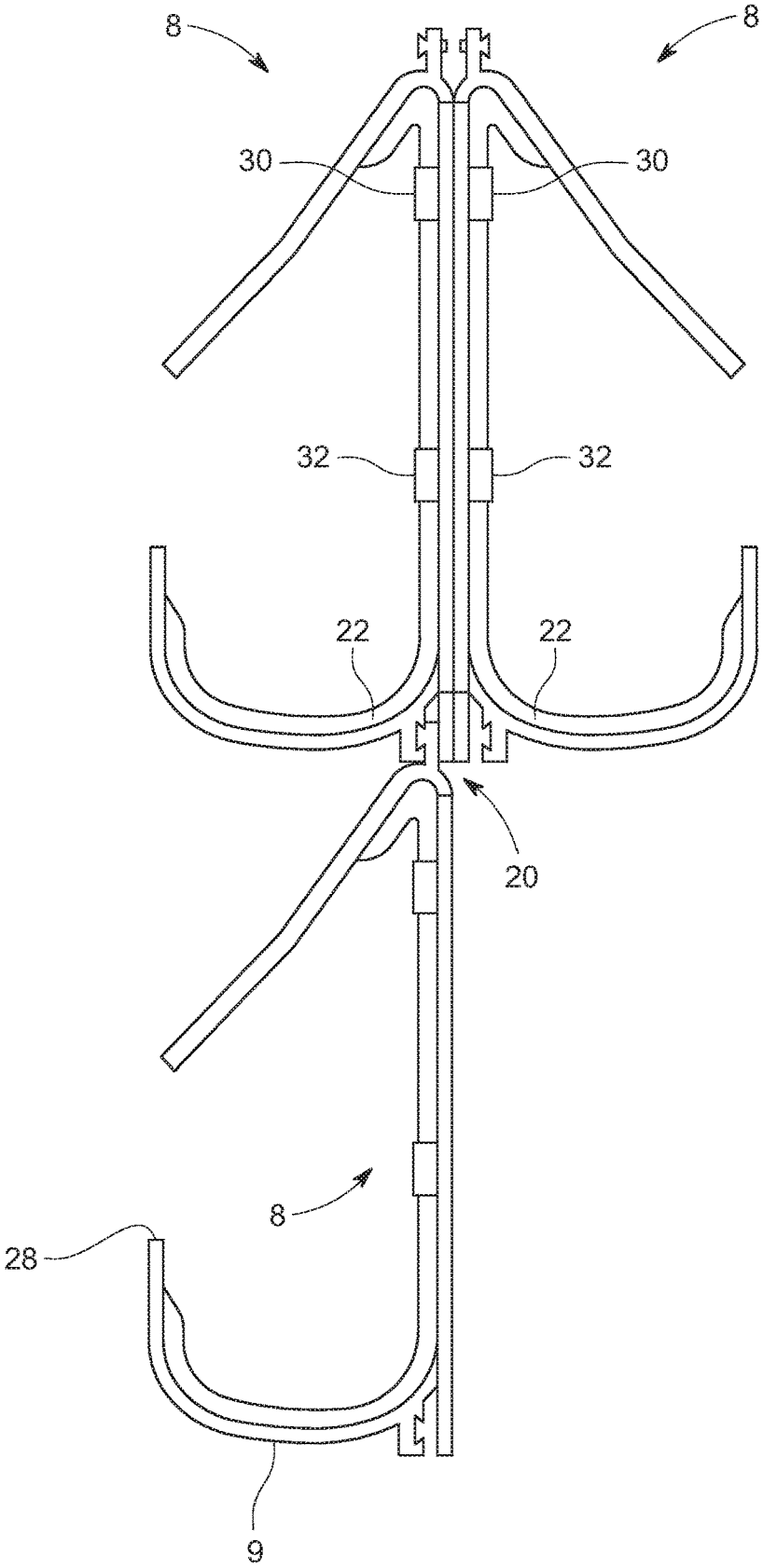
FIG. 4 is a side plan view of the multiple embodiments of FIGS. 2-3 connected back to back.

FIG. 4 shows multiple brackets 8 disposed in back to back arrangements. When connected in such a manner, the respective bores 30 and 32 may align with one another for such as connect together. Meanwhile, this figure also shows the connection of a top connector 20 to a lower connector 22 for vertically connecting brackets together as illustrated.

Figure 5:
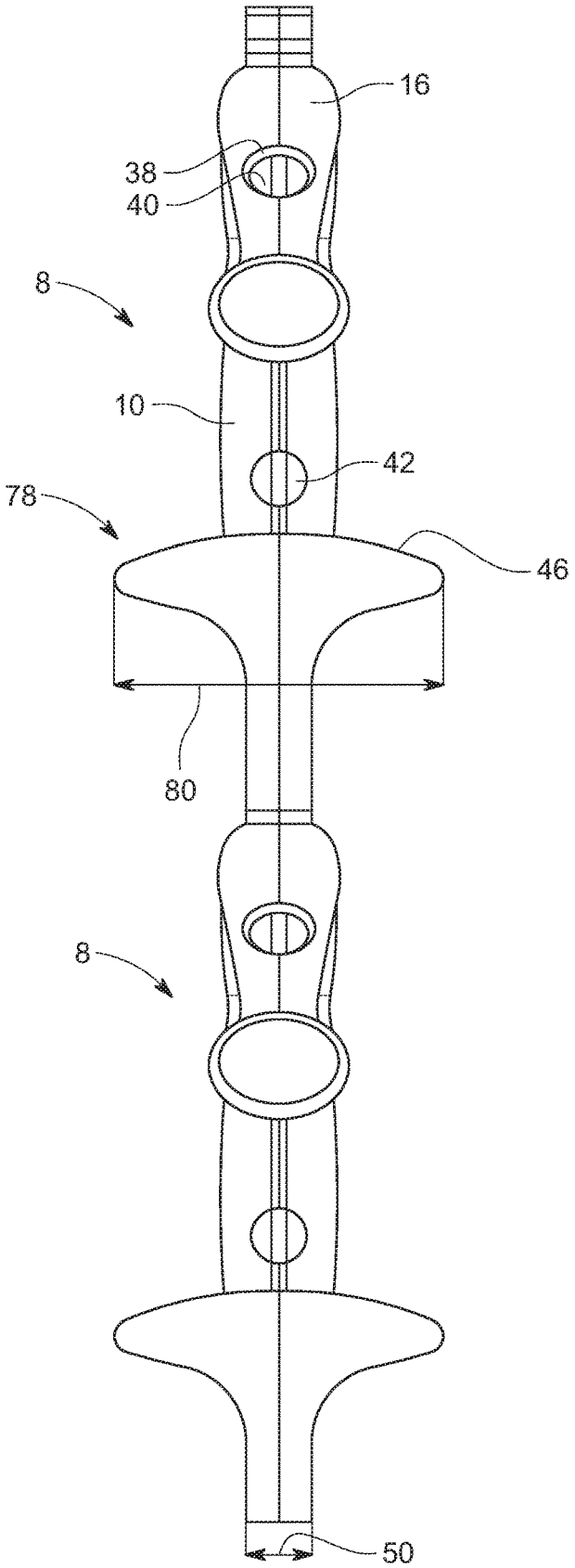
FIG. 5 is a front plan view of the two devices of the embodiment of FIGS. 2-4 connected top to bottom.

A front view is shown in FIG. 5 of two brackets 8 connected together. One will see that port 38 in the top arm 16 may be useful to direct a screw 40 through the hole 30 and screw 42 as illustrated being directed through the hole 32 in the back plate 10 as well for connecting to a vertically extending surface 44 which could be a wall, door other structure. With the bracket 8 connected to a vertical surface 44, multiple hats may be now installed if so desired as may be explained in further detail below. One will observe that the whale tail 28 may have a curved surface 46 which may extend a width 48 which is illustrated significantly wider than back width 50 of back plate 10.

Figure 6:
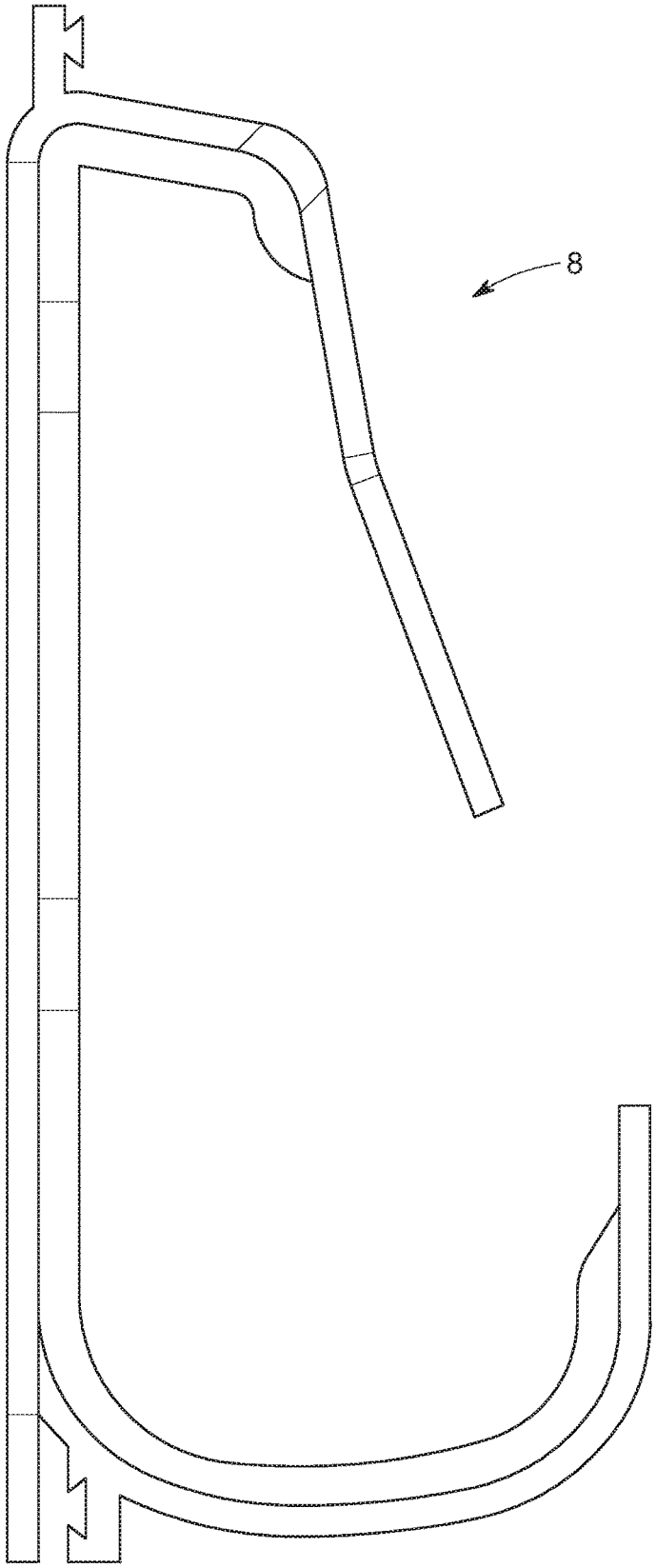
FIG. 6 is a side plan view of the embodiment of FIGS. 2-4.

FIG. 6 appears to be almost virtually identical to FIG. 2.

Figure 7:
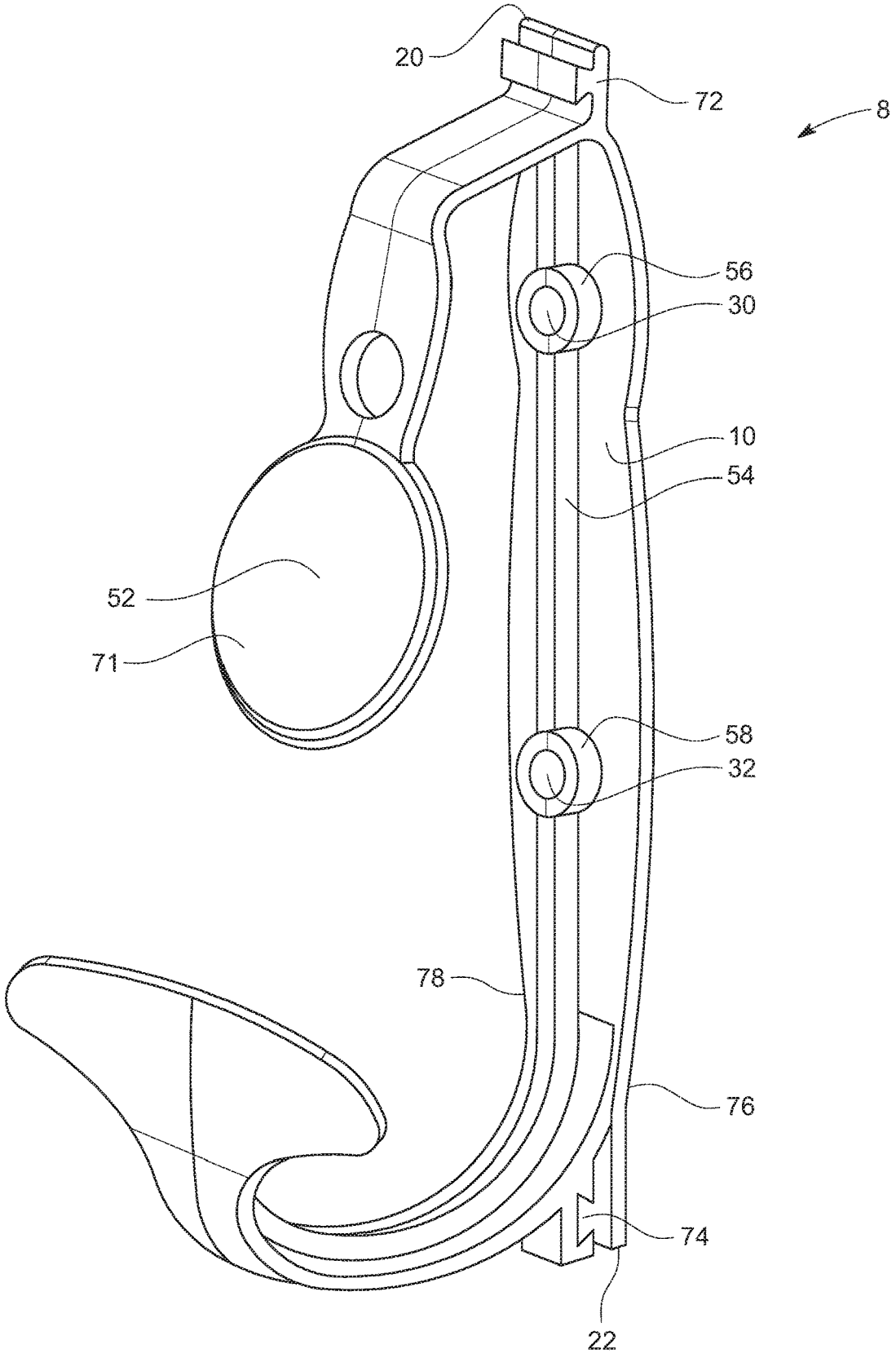
FIG. 7 is a side perspective view of the embodiments of FIGS. 2-6.

FIG. 7 shows a perspective view showing the marketing medallion 24 which may have a display area 52 which could appear above a bill of a hat when installed which will be explained in further detail below. A support ridge 54 forward of the back plate 10 may provide additional structural stability and/or provide wells 56,58 about the openings 30,32 to receive the connectors such as with an injected molded or other configuration to provide additional strength. Other embodiments have different constructions.

Figure 8:
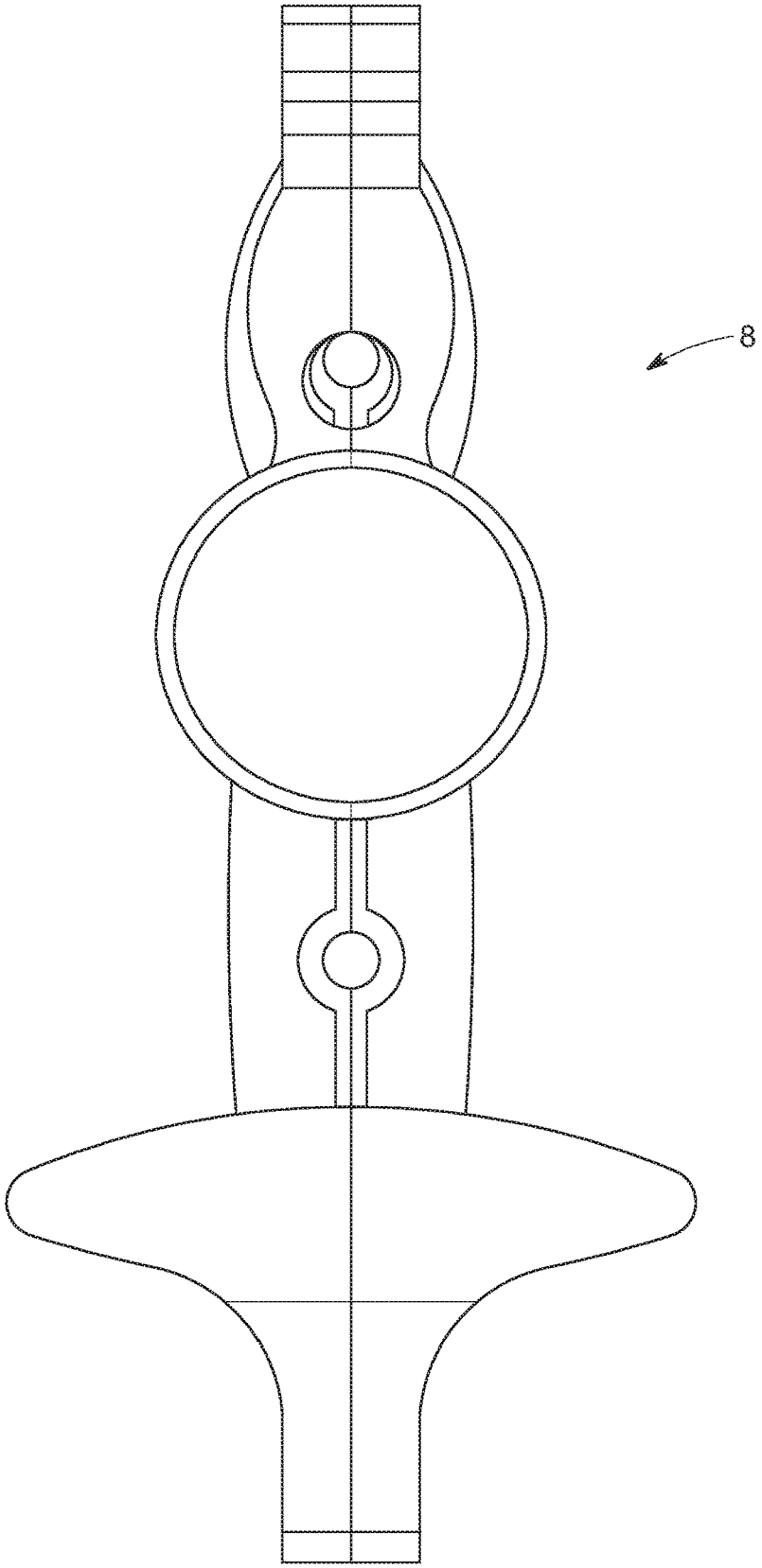
FIG. 8 is a front plan view of the embodiment of FIGS. 2-7.

FIG. 8 shows a front view similar to FIG. 5 of a single bracket and multiple brackets.

Figure 9:
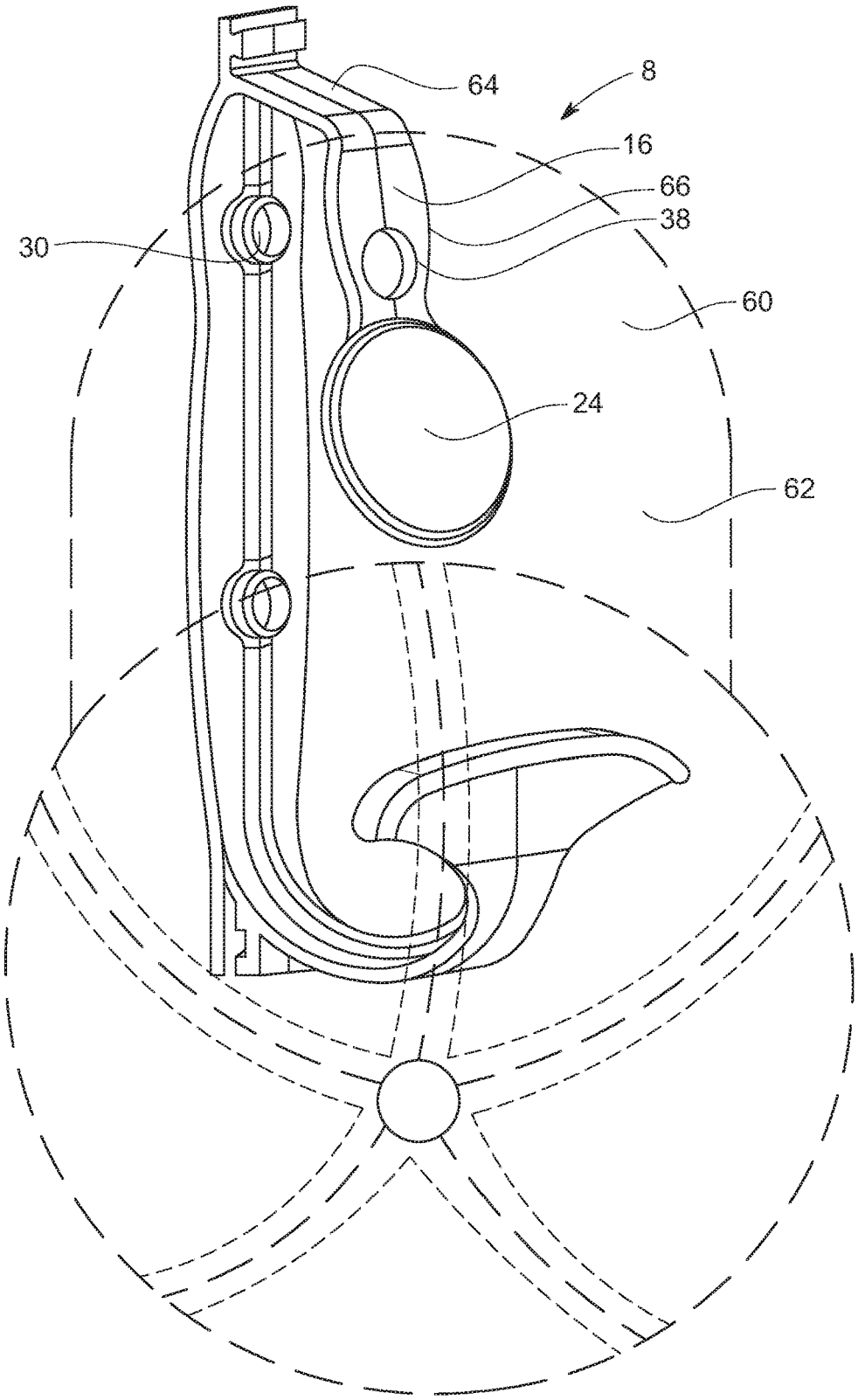
FIG. 9 is a side perspective view of the embodiment of FIGS. 2-8 with a hat (shown in phantom)
Figure 10:
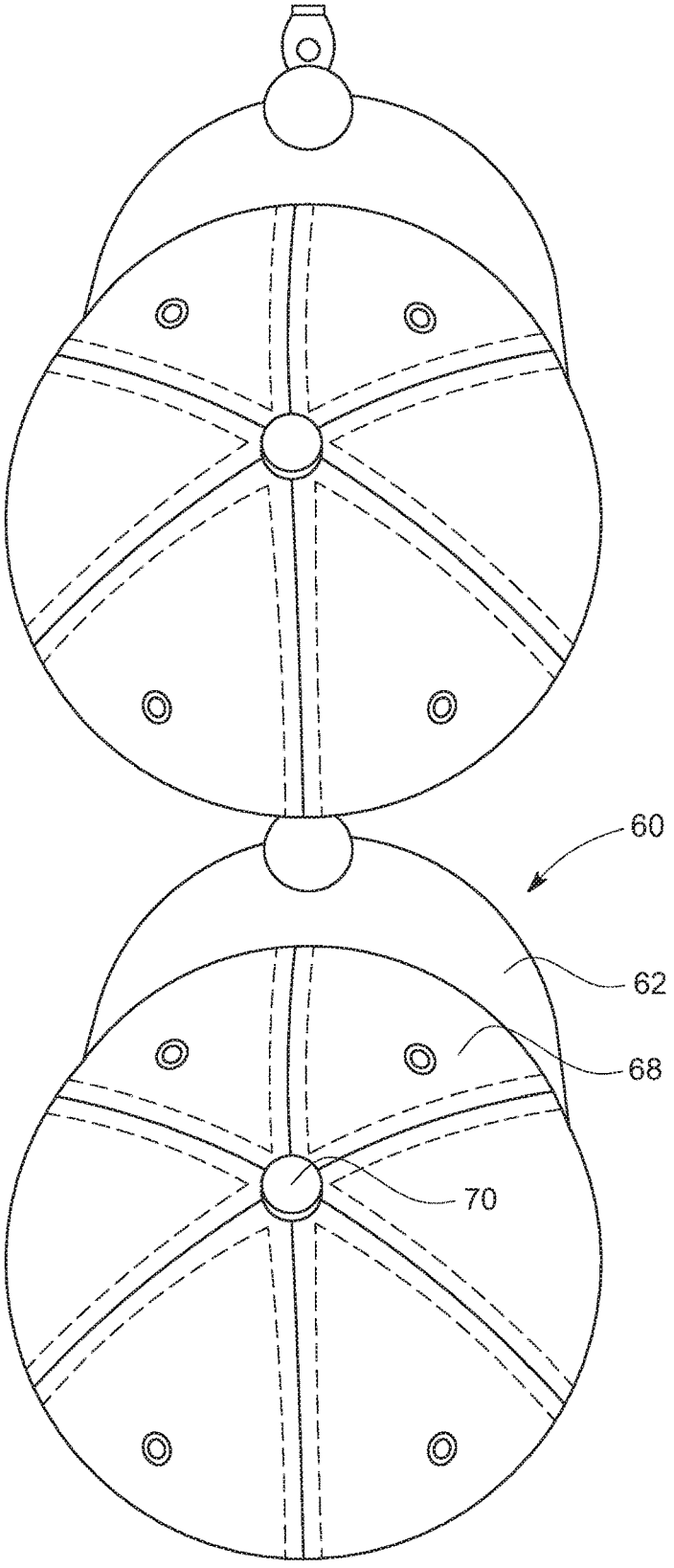
FIG. 10 is a front perspective view of multiple embodiments of FIGS. 2-9 with hats thereon.

FIG. 9 shows a bracket 8 with a hat 60 illustrated in phantom with bill 62 being received behind upper arm 16 which may have shoulder 64 connected to leg 66 which then connects to the marketing medallion 24 in an angular manner as illustrated or otherwise while providing a port 38 for accessing a screw 40 through the opening 30. The leg 66 may be angled relative to the shoulder 64 for this embodiment as well. Meanwhile, the hat 60 may be engaged at a front back of the bill where the crown contacts the whale tail 28 or other rest. The whale tail 28 may engage the hat 60 on the front back of the bill 62 and/or along a rear of the crown 68 of such a contact could eliminate stress on the bead 70, bill 62, and/or back of the hat 60 while providing a relatively large contact surface 46 to spread across the crown 68 so as to not deform the crown 68, bill 62, etc., due to contact. Additionally, by having the whale tail 28 extend past the back plate 10, additional balance is provided to the crown 68 for the hat 60. The whale tail 28 or other support preferably has a width 48 extending at least half a width of bill 62 if not further. Whale tail 28 may angle almost diagonally upward from base 9 to be somewhat c-shaped with back plate 10 for some embodiments.

FIG. 7-9 shows a trapezoidal nature of a male connector 20 having a trapezoidal cross section 72 as could be received internal to slot 74 of a female second connector 22 as by being slid in from either of the sides 76 and/or 78 so that then the nipple 34 could engage the recessed 36 to assist in securing the connectors 20,22 in position. Other connectors 20,22 may connect differently than the one illustrated. Multiple hats may be stacked on a single bracket 8, the backs of the hats could be folded (or not), possible as provided by the manufacturer.

Marketing medallion 24 by display arm 52 could be utilized for branding, marketing and/or other purposes.

Figure 11:
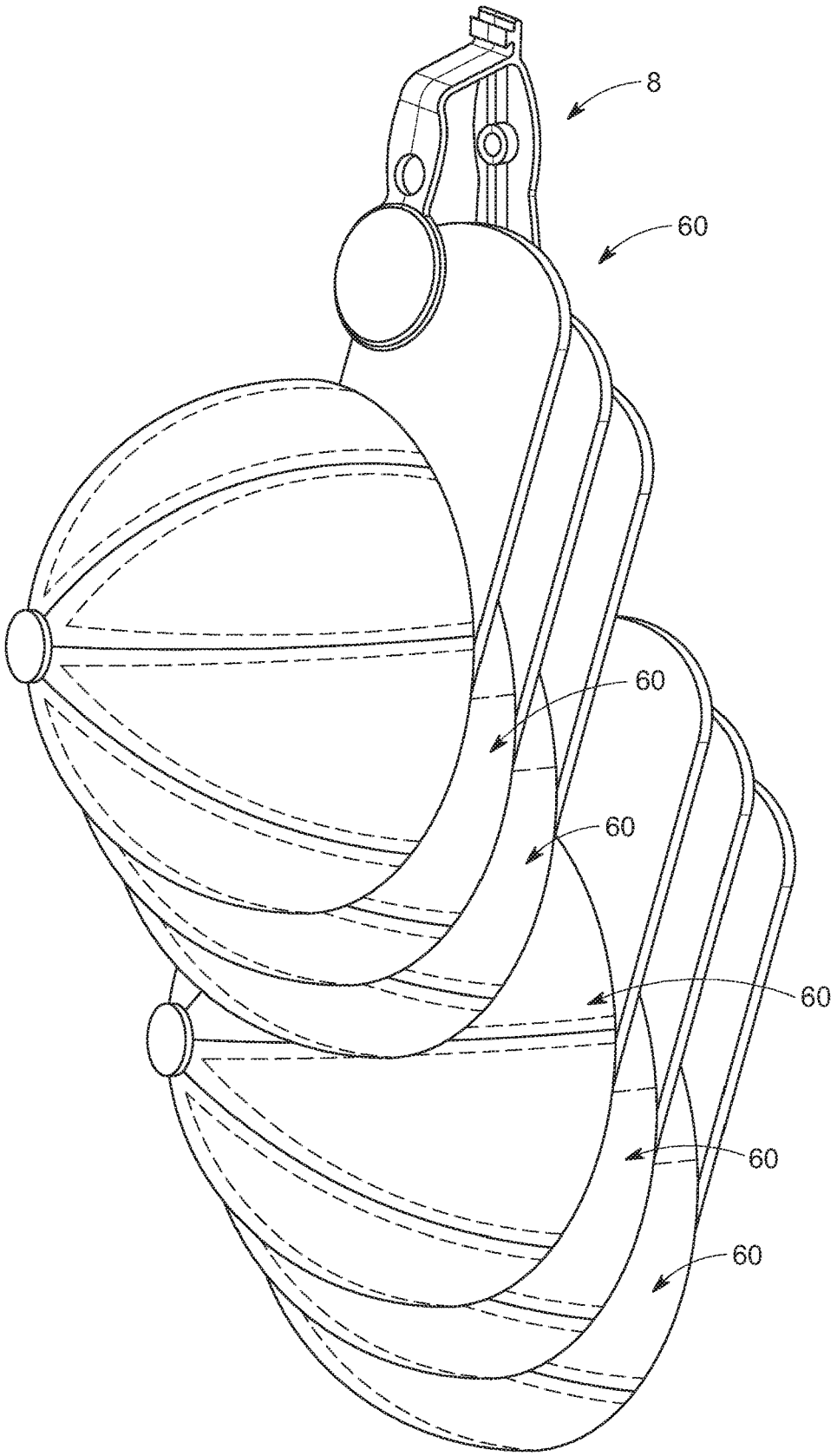
FIG. 11 is a side perspective view of the multiple embodiments of FIGS. 2-10.

FIG. 11 shows two brackets 8 connected together (a first and a second bracket) with three hats 60 (with back folded onto crown 68) on the top bracket 8 supported by the whale tail 28. The bottom bracket 8 has three hats 60 supported by crowns 68 in a typical stacked position.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A hat bracket in combination with a hat having a bill extending from a crown, said combination comprising:

a back plate;

a bottom arm connected at a bottom portion of the back plate and upwardly and forwardly extending relative to the back plate;

a top arm connected to an upper portion of the back plate extending downwardly and forwardly; and said bottom arm providing a hat support contacting, balancing and supporting the hat by a rear of the crown with the bill extending upwardly between the top arm and the back plate;

wherein the hat is supported by the hat bracket without applying stress to the bill; and wherein the back plate further comprises a first connector for use in directly connecting more than one of said hat bracket together.

2. The combination of claim 1 wherein the first connector is located at the upper portion of the back plate.

3. The combination of claim 2 wherein the first connector is located above the connection of the top arm to the back plate.

4. The combination of claim 1 wherein the first connector is one of a male connector and a trapezoidal slide.

5. The combination of claim 2 further comprising a second connector connected to the back plate at the bottom portion of the back plate.

6. The combination of claim 5 wherein the second connector is one of a female connector and a trapezoidal slide.

7. The combination of claim 6 wherein a nipple is received within a recess to assist in retaining the bracket to another bracket vertically.

8. A hat bracket in combination with a hat having a bill extending from a crown, said combination comprising:

a back plate;

a bottom arm connected at a bottom portion of the back plate and upwardly and forwardly extending relative to the back plate;

a top arm connected to an upper portion of the back plate extending downwardly and forwardly; and said bottom arm providing a hat support contacting, balancing and supporting the hat by a rear of the crown with the bill extending upwardly between the top arm and the back plate;

wherein the hat is supported by the hat bracket without applying stress to the bill; and a medallion at an end of the top arm.

9. The combination of claim 8 wherein the medallion is angled relative to the top arm.

10. A hat bracket in combination with a hat having a bill extending from a crown, said combination comprising:

a back plate;

a bottom arm connected at a bottom portion of the back plate and upwardly and forwardly extending relative to the back plate;

a top arm connected to an upper portion of the back plate extending downwardly and forwardly; and said bottom arm providing a hat support contacting, balancing and supporting the hat by a rear of the crown with the bill extending upwardly between the top arm and the back plate;

wherein the hat is supported by the hat bracket without applying stress to the bill; and wherein multiples of said bracket are connected directly together, with each bracket supporting at least one hat.

11. The combination of claim 10 wherein at least some said brackets are connected back to back.

12. The combination of claim 10 wherein the at least some brackets are connected vertically with a connector formed in the back plate towards a top of the back plate connecting to a connector formed into the back plate at a bottom of the back plate.

13. A hat bracket in combination with a hat having a bill extending from a crown, said combination comprising:

a back plate;

a bottom arm connected at a bottom portion of the back plate and upwardly and forwardly extending relative to the back plate;

a top arm connected to an upper portion of the back plate extending downwardly and forwardly; and said bottom arm providing a hat support contacting, balancing and supporting the hat by a rear of the crown with the bill extending upwardly between the top arm and the back plate;

wherein the hat is supported by the hat bracket without applying stress to the bill; and wherein the bottom arm terminates in a whale tail providing the hat support and the whale tale has a curved surface extending a width wider than a width of the back plate.

14. A method of storing hats having a bill extending from a crown comprising the steps of:

a) providing a bracket having:

a back plate, a bottom arm connected at a bottom portion of the back plate and upwardly and forwardly extending relative to the back plate;

a top arm connected to an upper portion of the back plate extending downwardly and forwardly; and said bottom arm providing a hat support;

b) supporting the hat by a rear the crown with the bill extending upwardly between the top arm and the back plate without applying stress to the bill with the top arm preventing outward rotation of the bill away from the back plate; and directly connecting multiples of said bracket together with hats thereon.

15. The method of claim 14 wherein the step of connecting comprises at least one of connecting the brackets together back to back and vertically.

* * * * *